United States Patent [19]

Bauman

[11] 4,421,514

[45] Dec. 20, 1983

[54] ANTISTATIC LAUNDRY TREATMENT

[75] Inventor: Robert A. Bauman, New Brunswick, N.J.

[73] Assignee: Colgate-Palmolive Company, New York, N.Y.

[21] Appl. No.: 404,721

[22] Filed: Aug. 3, 1982

[51] Int. Cl.[3] ..... D06M 13/20; B08B 3/04; B08B 3/08

[52] U.S. Cl. ..... 8/137; 252/8.6; 252/89.1; 252/174.21; 252/174.22

[58] Field of Search ..... 8/137; 252/8.6

[56] References Cited

U.S. PATENT DOCUMENTS

| | | | |
|---|---|---|---|
| 3,451,927 | 6/1969 | Tune | 252/8.8 |
| 3,590,122 | 6/1971 | Roberts et al. | 252/117 |
| 3,625,905 | 12/1971 | Weast | 252/109 |
| 3,870,555 | 3/1975 | Swidler et al. | 8/137 |
| 3,953,351 | 4/1976 | Keller | 252/132 |
| 3,954,632 | 5/1976 | Gloss | 252/155 |
| 4,079,078 | 3/1978 | Collins | 252/118 |
| 4,087,555 | 5/1978 | Barnett et al. | 424/357 |
| 4,097,403 | 6/1978 | Tsutsumi et al. | 252/312 |
| 4,105,592 | 8/1978 | Collins | 252/545 |
| 4,285,841 | 8/1981 | Barrat et al. | 252/559 |
| 4,287,082 | 9/1981 | Tolfo et al. | 252/174.12 |

*Primary Examiner*—Maria Parrish Tungol
*Attorney, Agent, or Firm*—Norman Blumenkopf; Herbert S. Sylvester; Murray M. Grill

[57] ABSTRACT

Isostearic acid useful as an antistatic agent in the laundering of fabrics with all-nonionic detergents which may optionally contain optical brighteners, without interfering with the whitening properties of said optical brighteners.

7 Claims, No Drawings

ANTISTATIC LAUNDRY TREATMENT

BACKGROUND AND PRIOR ART

This invention relates to a method of imparting antistatic properties to fabrics, which consists in treating fabrics with an antistatic amount of isostearic acid during laundering with a nonionic detergent at a maximum pH of 8, said isostearic acid being separately added during the wash cycle.

Synthetic fabrics are very prone to develop a static electrical charge from friction, as during tumble drying after laundering, or in normal use or wear.

The use of various and diverse chemical materials and particularly cationic quaternary ammonium compounds as softeners and antistatic agents for textile products is very well known in the art. It is also well known to employ such materials for their antistatic and softening effects during the laundering operation and particularly in the rinse cycle of the laundering process. This latter technique has been necessitated by the fact that the aforesaid quaternary compounds heretofore employed, being mainly cationic in nature, were not compatible with the anionic detergents, one of the major types of detergents used in the washing cycle.

In addition, the usual quaternary ammonium salt antistatic agents have limited effectiveness in all-nonionic detergents.

It is also well known that there is a tendency for laundered articles to yellow or discolor when treated with aforesaid quaternary compounds.

Another disadvantage associated with the use of said cationic agents in the laundering of fabrics therewith is its interference with the deposition on the fabrics of optical brightener, thereby reducing optical brightener performance of a detergent composition containing said optical brightener.

Still another disadvantage of the cationic quaternary ammonium antistatic softeners is its interference with the cleaning properties of the detergent by reducing the soil removal effected by the detergent, resulting in decreased washing effectiveness. The presence of the anionic detergent material substantially negates the fabric softening properties of the cationic quaternary ammonium compounds as well as counteracts the minimal antistatic activity possessed by said quaternary compounds.

Accordingly, aforesaid quaternary agents have been combined with an alkyl ethanolamide in the rinse cycle in order to provide antistaticity to synthetic fabrics such as nylon, as shown in U.S. Pat. No. 3,451,927.

U.S. Pat. No. 3,954,632 discloses a fabric softening and antistatic composition compatible with anionic, nonionic and ampholytic detergent compositions comprising a particular smectite clay material, cationic antistatic agents and acidic compatibilizing agents such as fatty acids, to be used as an additive to the laundry washing bath.

Fatty acids have been used in liquid detergent compositions comprising mixtures of anionic and nonionic surfactants as a corrosion inhibitor, shown in U.S. Pat. Nos. 4,079,078 and 4,105,592; as cleaning enhancers in the absence of builders, shown in U.S. Pat. No. 4,285,841; as stability agents in enzyme-containing detergents, shown in U.S. Pat. No. 4,287,082; and as a major ingredient together with a nonionic surfactant to yield better overall washing efficiency in laundry operations, shown in U.S. Pat. No. 3,953,351.

Isostearic acid has been used in an oil/water skin cream composition as a dispersing agent in said oil phase, shown in U.S. Pat. No. 4,087,555; as one component in a four component emulsifying or solubilizing composition, shown in U.S. Pat. No. 4,097,403; and as a conditioning agent in conjunction with a surfactant in shampoo compositions, shown in U.S. Pat. No. 3,590,122.

U.S. Pat. No. 3,625,905 discloses a cleansing and softening composition for fabrics comprising a noncationic surfactant and an alkali metal isostearate salt as the softening agent.

However, none of the prior art discloses the method of treating fabrics with isostearic acid during the wash cycle to impart antistatic properties to fabrics laundered with nonionic detergent.

SUMMARY OF THE INVENTION

It has now been discovered that isostearic acid provides an effective treatment to overcome the development of static charge during drying after laundering or in the normal use or wear of synthetic fabrics. It has also been found that this treatment can be applied successfully during laundering.

Accordingly, it is a primary object of the instant invention to provide fabrics with a protective treatment during laundering against the subsequent generation of static charge.

Another object of the invention is to provide an antistatic agent which is effective in the presence of nonionic surfactants.

Still another object of the instant invention is to provide such protection in conjunction with all-nonionic detergent compositions during the home laundering process.

A further object of the instant invention is to provide antistatic protection which does not interfere with optical brightener performance.

Still a further object of instant invention is to provide a method of utilizing isostearic acid as a wash cycle additive during the laundering of fabrics with nonionic surfactants.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

To achieve the foregoing and other objects and in accordance with the present invention, as embodied and broadly described herein, the method of this invention imparts antistatic properties to synthetic fabrics which comprises treating fabrics with an antistatic amount of isostearic acid during laundering with an all-nonionic detergent. Other fatty acids such as decanoic, stearic, ricinoleic and dimer acids have been found ineffective as antistatic agents in the presence of nonionic surfactants.

More specifically, present invention relates to a method of imparting antistatic properties to fabrics during laundering, which comprises separately adding isostearic acid to the wash water containing a nonionic detergent, maintaining said wash water at a maximum pH of about 8, and laundering said fabrics in the presence of said isostearic acid.

Isostearic acid is a liquid $C_{18}$ saturated branched-chain isomer of stearic acid of the formula $C_{17}H_{35}COOH$, having primarily methyl branching. Isostearic acid is a water-insoluble oil having a molecular weight of about 284, a maximum titer of about 10° C., an iodine value of about 10 maximum, a saponification value of about 180 minimum and comprises preferably a methyl group in the 8, 9 or 10 position. However, said methyl group side chain may be positioned on any but the terminal carbon atom. A suitable commercial product is Emersol 871 (Emery Industries) which is a complex mixture of branched isomers of stearic acid.

Isostearic acid reduces or prevents the generation of static electricity on synthetic fabrics during laundering. These antistatic properties can be imparted to fabrics by laundering in a nonionic detergent composition with a wash cycle addition of isostearic acid which causes the codeposition of said nonionic surfactant and the isostearic acid onto the fabric. The nonionic surfactant is rendered substantive to the fabric and is retained after rinsing due to the presence of the isostearic acid. It is this unexpected coaction between the nonionic surfactant and the isostearic acid which imparts antistatic properties to fabrics treated herewith, since neither the isostearic acid per se, nor the nonionic surfactant per se, is capable of imparting antistatic properties to fabric during the laundering process. This beneficial effect is achieved without adversely affecting the detergency of the nonionic surfactant and without interference with the action of optical brighteners that may be present in the detergent composition.

It has additionally been found that the static decreases with the use of increasing amounts of isostearic acid, particularly on polyester (dacron), nylon, and polyester-cotton fabrics. Accordingly, the antistatic amount of isostearic acid may be as low as 1 g and up to 10 g per 60 liters of wash water, which is equivalent to about 0.002–0.02% of wash solution.

It has also been found that the pH of the wash water should not exceed 8, because the antistatic activity of isostearic acid is inactivated by the alkali. The presence of chlorine bleach in the wash water destroys the antistatic activity of the isostearic acid. This is probably due to the high alkalinity. Analysis indicates that under alkaline conditions most of the acid has been converted to the salt. Lack of static protection under these circumstances indicates the ineffectiveness of the isostearate salts as antistatic agents. The antistatic property is specific only to the isostearic acid in free acid form. The presence of salts such as $CaCl_2$ or $MgSO_4$ (as in hard water) does not adversely affect the antistatic properties of the isostearic acid, provided the pH does not exceed about 8. Accordingly, the detergent must be free of alkaline builder salts.

It has additionally been found that the isostearic acid is inactivated by premixing with the nonionic surfactant. Accordingly, it is essential that the isostearic acid be added to the wash water separately from the addition of the nonionic detergent. The affinity between the isostearic acid and the nonionic surfactant is believed to prevent the codeposition of said nonionic surfactant and isostearic acid, thereby interfering with the antistatic function of said combination.

In accordance with this invention, the nonionic surfactants for use as the fabric detergent are commercially well known and include the primary aliphatic alcohol ethoxylates, secondary aliphatic alcohol ethoxylates, alkylphenol ethoxylates and the alcohol ethylene oxide-propylene oxide condensates such as Plurafacs (Wyandotte), and mixtures thereof. The nonionic synthetic organic detergents are generally the condensation product of an organic aliphatic or alkyl aromatic hydrophobic compound and hydrophilic ethylene oxide groups. Practically any hydrophobic compound having a carboxy, hydroxy, amido, or amino group with a free hydrogen attached to the nitrogen can be condensed with ethylene oxide or with the polyhydration product thereof, polyethylene glycol, to form a nonionic detergent. Further, the length of the polyethenoxy chain can be adjusted to achieve the desired balance between the hydrophobic and hydrophilic elements.

The nonionic detergents include the polyethylene oxide condensate of one mole of alkyl phenol containing from about 6 to 12 carbon atoms in a straight- or branched-chain configuration with about 5 to 30 moles of ethylene oxide, for example, nonyl phenol condensed with 9 moles of ethylene oxide, dodecyl phenol condensed with 15 moles of ethylene and dinonyl phenol condensed with 15 moles of ethylene oxide. Condensation products of the corresponding alkyl thiophenols with 5 to 30 moles of ethylene oxide are also suitable.

Also included in the nonionic detergent class are the condensation products of a higher alcohol (e.g. an alkanol containing about 8 to 18 carbon atoms in a straight or branched-chain configuration) condensed with about 5 to 30 moles of ethylene oxide, for example, lauryl-myristyl alcohol condensed with about 16 moles of ethylene oxide.

A preferred group of nonionic surfactants are the Neodol ethoxylates (Shell Co.), which are higher aliphatic alcohol ethoxylates having about 5 to 20 ethyleneoxy groups per mole of aliphatic alcohol containing about 10–18 carbon atoms, such as $C_{12-13}$ alkanol condensed with 6.5 moles ethylene oxide, $C_{12-15}$ alkanol condensed with 12 moles ethylene oxide, $C_{14-15}$ alkanol condensed with 13 moles ethylene oxide, and the like. Ethoxamers having an HLB (hydrophobic lipophilic balance) value of about 8–15 gives good O/W emulsification, whereas ethoxamers with low HLB values (below 8) contain less than 5 ethyleneoxy groups, and are poor emulsifiers and poor nonionic detergents. When the poor emulsifiers are premixed with the isostearic acid, acceptable fabric deposition occurs; whereas the good emulsifiers prevent the deposition of the isostearic acid on the fabric. Accordingly, it is necessary that the isostearic acid be used as a wash cycle additive in the laundering process with nonionic surfactants of satisfactory detergency.

The nonionic detergent composition of the instant invention may also include conventional laundering additives such as optical brighteners, germicides, soil suspending agents, anti-redisposition agents, antioxidants, coloring materials (dyes and pigments), perfumes, water-soluble alcohols, foam boosters, etc., provided they do not interfere with the antistatic activity of the isostearic acid.

DETAILED DESCRIPTION OF THE INVENTION

The following examples specifically illustrate the method of this invention. However, it is merely illustrative thereof and it is not limited thereto.

EXAMPLES 1-5

A nonionic liquid detergent, is prepared by mixing to homogeneity Neodol 23-6.5[1] (33%), Tinopal 5BM[2] (0.66%), ethyl alcohol (8.3%) and water (58%). To 60 g of this detergent in 66 liters tap water at 120° F. in a Whirlpool washer is added 0, 3 or 6 g of either isostearic acid or Arosurf TA-100 (distearyl dimethyl ammonium chloride) followed by a fabric load of approximately 200 sq. in. swatches of polyester double knit twill (P), Banlon nylon (N), a 65-35% blend of polyester-cotton (PC) and cotton percale (C) as well as 4 each of 3"×4" standard soiled swatches—Test Fabric nylon (TFN) and cotton (TFC), Scientific Services Clay/cotton (SSC) and clay/polyester-cotton (SSPC) and EMPA 101 cloth. Subsequently, the fabrics are dried in Westinghouse electric tumble dryers. Reflectance of the soiled swatches are read as a measure of detergency ($R_D$), fluorescence of the cotton swatches as a measure of brightener effectiveness ($R_b$), and the charge developed on the synthetic fabrics after rubbing 5 sec. with wool at low relative humidity as a measure of antistatic effectiveness (charge). Duplicate experiments are run for each case in separate washers and dryers and the results are averaged.

[1]ethoxylated $C_{12-13}$ aliphatic alcohol having an average of 6.5 moles ethylene oxide (Shell Co.).
[2]a stilbene brightener (Ciga-Geigy).

| Ex. | Antistatic Agent | Charge (KV)* P | N | PC | $R_b$** C | $R_D$*** TFN | TFC | SSC | SSPC | EMPA |
|---|---|---|---|---|---|---|---|---|---|---|
| 1 | None | 11.5 | 2.4 | 24.0 | 206 | 54.5 | 34.7 | 61.5 | 71.1 | 17.2 |
| 2 | 3 g Arosurf TA-100 | 5.7 | 13.8 | 25.5 | 38 | 44.2 | 33.1 | 62.1 | 69.2 | 18.3 |
| 3 | 3 g Isostearic acid | 0.6 | 0.3 | 14.2 | 232 | 42.1 | 34.6 | 63.3 | 72.8 | 17.1 |
| 4 | 6 g Arosurf TA-100 | 2.2 | 13.0 | 19.5 | 28 | 38.9 | 33.5 | 61.5 | 69.7 | 17.6 |
| 5 | 6 g Isostearic acid | 0.6 | 0.3 | 3.1 | 234 | 31.8 | 35.1 | 63.0 | 65.9 | 17.9 |

*A lower number indicates less charge developed or better antistatic performance.
**A higher number indicates more fluorescence or better brightener performance.
***A higher number indicates more light reflection or cleaner fabric.

It is readily apparent that isostearic acid gives much better static suppression than Arosurf TA-100 at half the concentration, does not interfere with brightener performance as does the quaternary, and affects detergency only insignificantly more than the quaternary.

EXAMPLES 6-13

Swatches of dacron (D), nylon (N), dacron-cotton (DC) and acetate (Ac) are washed at 120° F./cold rinse and tumble dried, using 20 g Neodol 23-6.5 as the detergent in the washing machine. After filling with water and 1 minute of agitation, the isostearic acid is added, and after another minute, the fabrics are added to the washer.

| Ex. | Isostearic Acid (g) | Dryer Static | Wt. gain Dacron | D | N | DC | Ac | Sum |
|---|---|---|---|---|---|---|---|---|
| 6 & 7 | 0 | yes | 0,0 | −1.4 | −9.3 | >−16 | ±2.0 | 29 |
| 8 & 9 | 2 | no | 0.3, 0.2 | −1.1 | ±2.6 | −10.3 | −3.2 | 17 |
| 10 & 11 | 4 | no | 0.95, 0.75 | −0.4 | ±0.5 | −4.3 | −4.7 | 10 |
| 12 & 13 | 6 | no | 1.50, 1.45 | −0.5 | −0.5 | −1.0 | −4.6 | 7 |

Isostearic acid shows a definite dose response effect on polyester, nylon and polyester-cotton, but not on acetate jersey. Overall, the static decreases with increasing amount of isostearic acid used.

EXAMPLES 14 & 15

Swatches of fabrics as in Examples 6-13, plus a towel, are washed 1, 2 and 4 times in nonionic detergent containing either 1 g isostearic acid or 1 g Arosurf TA-100 each time, with no drying between washes. The same procedure as in Examples 6-13 are followed, namely, the detergent is added while filling the washer with water. After 1 minute, the quaternary or the isostearic acid is added to the wash water. After 1 more minute, the fabrics are added which are washed for 14 minutes at 120° F. After the final wash, the fabrics are tumble dried.

| Ex. | Washes | Dryer Static | Wt. Gain Dacron | Static Test D | N | DC | Ac | Sum |
|---|---|---|---|---|---|---|---|---|
| Quat | | | | | | | | |
| 14 | 1 | yes | 0 | −8.0 | −18.0 | −21 | +1.8 | 49 |
| | 2 | yes | 0 | −10.0 | −15.0 | −19.5 | +1.5 | 50 |
| | 4 | yes | 0 | −9.0 | −16.5 | −16.5 | +3.8 | 46 |
| Isostearic Acid | | | | | | | | |
| 15 | 1 | yes | .10 g | −7.5 | +2.4 | −10.5 | +1.5 | 22 |
| | 2 | no | .15 | −3.1 | +2.1 | −8.5 | +2.8 | 16 |
| | 4 | slight | .−18 | −4.0 | +2.1 | −13.5 | +3.4 | 23 |

EXAMPLES 16 & 17

Repeat Examples 14 and 15 using 2 g of antistatic agent in the wash cycle instead of 1 g.

| Ex. | Washes | Dryer Static | Wt. Gain Dacron | Static Test D | N | D/C | Ac | Sum |
|---|---|---|---|---|---|---|---|---|
| Quat | | | | | | | | |
| 16 | 1 | yes | 0 | −8.0 | −16.5 | −15.8 | +5.5 | 46 |
| | 2 | yes | 0 | −8.5 | −16.0 | −15.8 | +5.0 | 45 |
| | 4 | yes | 0 | −7.2 | −13.5 | −16.0 | +7.0 | 44 |
| Isostearic Acid | | | | | | | | |
| 17 | 1 | no | .38 | −.62 | +.25 | −3.0 | +1.5 | 5 |
| | 2 | no | .40 | −.68 | +.55 | −0.6 | +1.35 | 3 |
| | 4 | no | .60 | −.75 | +.65 | −0.85 | +.35 | 3 |

At the 2 g level, Isostearic acid is very effective at one wash and slightly better on repeated washes.

Quaternary is ineffective as antistatic even after 4 washes. However, it does soften.

Light reflectance readings ($R_D$) on the laundered swatches after 1, 2 and 4 washes in Examples 14–17 remain substantially the same, using either 1 g or 2 g of the quaternary or isostearic acid, which is indicative of substantially no adverse effects on the detergency properties of the nonionic surfactant. However, fluorescence ($R_b$) readings on the laundered cotton terry, polyester-cotton and the banlon nylon swatches increases with multiple washes with the use of isostearic acid, which is indicative of increasing brightener pickup and increased brightener performance. However, the quaternary treated swatches exhibit much greater yellowing after repeated washes, and considerable interference with brightener performance, except on the acetate swatches.

Although the present invention has been described and illustrated with reference to specific examples, it is understood that modifications and variations of composition and procedure are contemplated within the scope of the following claims.

I claim:

1. A method of imparting antistatic properties to fabrics during laundering, which comprises separately adding an antistatic amount of isostearic acid to the wash water containing a nonionic detergent at a maximum pH of about 8.

2. A method according to claim 1, wherein the isostearic acid is a mixture of branched isomers of stearic acid.

3. A method according to claim 1, wherein the nonionic detergent composition contains an optical brightener.

4. A method according to claim 1, wherein the nonionic detergent composition is free of alkaline builder salts.

5. A method according to claim 1, wherein the nonionic detergent is the condensation product of an organic aliphatic or alkyl aromatic hydrophobic compound and hydrophilic ethylene oxide groups.

6. A method according to claim 1, wherein said nonionic detergent is a condensation product of an alkanol containing about 8 to 18 carbon atoms in a straight or branched-chain configuration condensed with about 5 to 30 moles ethylene oxide.

7. A method according to claim 1, wherein the nonionic detergent is selected from the group consisting of primary aliphatic alcohol ethoxylates, secondary aliphatic alcohol ethoxylates, alkylphenol ethoxylates, alcohol ethylene oxide-propylene oxide condensates, and mixtures thereof.

* * * * *